US006254098B1

(12) United States Patent
Kirkpatrick

(10) Patent No.: US 6,254,098 B1
(45) Date of Patent: Jul. 3, 2001

(54) PRACTICAL FOUR-DIMENSIONAL TIC-TAC-TOE

(76) Inventor: Francis H Kirkpatrick, 37 Clover Hill Dr., Chelmsford, MA (US) 01824

( * ) Notice: Subject to any disclaimer, the term of this patent is extended or adjusted under 35 U.S.C. 154(b) by 0 days.

(21) Appl. No.: 09/260,165

(22) Filed: Mar. 1, 1999

Related U.S. Application Data

(60) Provisional application No. 60/076,550, filed on Mar. 2, 1998.

(51) Int. Cl.[7] ..... A63F 3/00
(52) U.S. Cl. ..... 273/271; 273/264
(58) Field of Search ..... 273/271, 264, 273/241

(56) References Cited

U.S. PATENT DOCUMENTS 3,749,401 * 7/1973 Hayko ..... 273/271
4,131,282 12/1978 Boyer et al. ..... 273/271
4,275,442 * 6/1981 Underwood et al. ..... 273/271
4,371,169 2/1983 Compton ..... 273/271
4,884,819 * 12/1989 Lambert ..... 273/271

* cited by examiner

*Primary Examiner*—Benjamin H. Layno
(74) *Attorney, Agent, or Firm*—Francis H Kirkpatrick

(57) ABSTRACT

A layout which is practically useful for playing tic-tac-toe (TTT) in four dimensions is disclosed. The layout consists of an array of tiles, each tile containing a 5×5 array of substantially square cells, where the tiles are arrayed in a 5×5 pattern. For ease of visual interpretation, the tiles are preferably separated by approximately the width of a cell. The layout is implemented physically or as an electronic program coupled to a display. The rules are analogous to classical TTT; two variants are described.

21 Claims, 2 Drawing Sheets

PRACTICAL FOUR-DIMENSIONAL TIC-TAC-TOE

CONTINUATION INFORMATION

This application is a continuation-in-part of provisional application U.S. No. 60/076,550, filed Mar. 2, 1998, now abandoned.

FIELD OF THE INVENTION

A layout and a method of play which are practically useful for playing tic-tac-toe (TTT) in four dimensions are disclosed. The layout consists of an array of tiles, each tile containing a 5×5 array of substantially square cells, where the tiles are arrayed in a 5×5 pattern. For ease of visual interpretation, the tiles should be separated by approximately the width of a cell. The layout may be implemented physically or electronically. The rules are analogous to classical TTT; two variants are described.

BACKGROUND

The ordinary two-dimensional (2D) game of tic-tac-toe (TTT), having 3×3 cells, is well known. It is suitable for play by children, but there are relatively few strategies, and most players with experience achieve the theoretically-predicted draw.

TTT has been implemented in three dimensions (3D) by vertical stacking of boards, each of 3×3 or 4×4 cells, and respectively 3 or 4 high. The 3×3×3 version is a trivial win for the first player to move in a two-player game (two-player games are assumed herein unless otherwise stated.) The more complex 4×4×4 3-D game has been predicted to be a win for the first player, although the strategy is less directly obvious from the 2D 3×3 game than is the strategy for the 3×3×3. Vertically stacked games in both formats have been sold from time to time, but have not been commercially successful on a continuing basis. This may be because they are physically complex, taking up space and being prone to breakage; or because they are not satisfyingly complex in terms of strategy. In either case, no following has developed (compare Monopoly®—or even Othello™).

There do not appear to be examples of the proposed board structure or layout in the art, and in particular in U.S. Class 273/271 ("Tic-Tac-Toe games"). Compton (U.S. 4,371,169) proposed "imaginary multilevel tic-tac-toe". In FIG. 7 of Compton, a 1-dimensional array of 3×3 boards is shown; in FIG. 9, a crossed arrangement of 3×3 boards is illustrated; and in FIG. 2A, the 3×3 boards are arranged circularly. Boyer et al (U.S. 4,131,282) illustrate a 3×3 array of tiles each tile having a 3×3 array of cells (a "3×3:3×3" array), and propose a n×n:n×n array where n is an integer. However, the proposed rules of play in Boyer et al involve a multiplicity of colors and do not correspond to classical TTT, or to the rules proposed here.

SUMMARY OF THE INVENTION

A method for playing tic-tac-toe (TTT), also known as "naughts and crosses", in four dimensions (4D) is disclosed, in which the game board consists of a 5×5 array of tiles, each tile of which is composed of a 5×5 array of cells. This is illustrated in FIG. 1. The rules of play are analogous to those in three dimensional TTT. Each player has a particular mark, or type or color of piece. Each plays one mark or piece in turn; played pieces are not moved or removed. The winner is the first player to complete a row of five pieces or marks ("pieces"), where the concept of "row" includes both a conventional two-dimensional (2D) TTT row—horizontal, vertical or diagonal within a single tile—and the equivalent when a "super-row" of five tiles is projected onto a horizontal plane. A super-row is a row of tiles, where the allowed twelve patterns are the same as in conventional TTT if the tiles are considered as cells—i.e., the five (5) horizontal rows, the five (5) vertical rows, and the two (2) diagonals. At least two variants of the conventional rules for TTT are possible on such a game board.

In the figures, the space separating the 5×5 tiles is shaded in black, for convenience in composition. This is not a necessary feature. It is also possible to have a thin line at the edge of each tile, and a "white" space separating the tiles. Alternatively, the background on which all the tiles lie can have a different color or shading comparred to the color of the spaces in the tiles. Any type of color or shading which achieves the required effect (25 tiles on a background, separated by about one cell's width) is within the scope of the invention.

DETAILED DESCRIPTION OF THE INVENTION

The invention is in one aspect a practical method for playing tic-tac-toe (TTT) in four dimensions (4D). The invention provides a particular board for playing 4D TTT, in which the board consists of an array of tiles, each tile consisting essentially of a 5×5 array of substantially square cells, and the lines or other demarcations separating the cells. (Note that the cells and tiles in each of the Figures are computer printouts, and are not necessarily exactly square). Most preferably, the cells are exactly square. However, and particularly in electronic implementations, exact squareness may not be practical. Such boards may still be playable, but the ratios of the "horizontal" and "vertical" extents of a cell should be comparable, for example differing by 25% or less, more preferably by 15% or less, still more preferably by 10% or less, most preferably by 5% or less.

Figure 1:
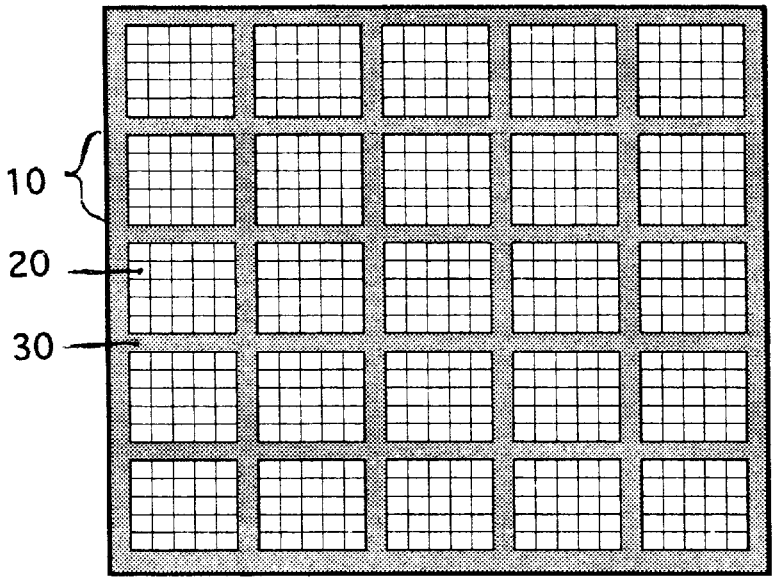
FIG. 1 shows the 5×5:5×5 array of the game board of the invention. The board consists of a 5×5 array of tiles (10) each of which comprises a 5×5 array of cells (20). Preferably, each tile is visually separated by a space (30); the preferred dimension of the space is about that of the side of a cell.
Figure 4:
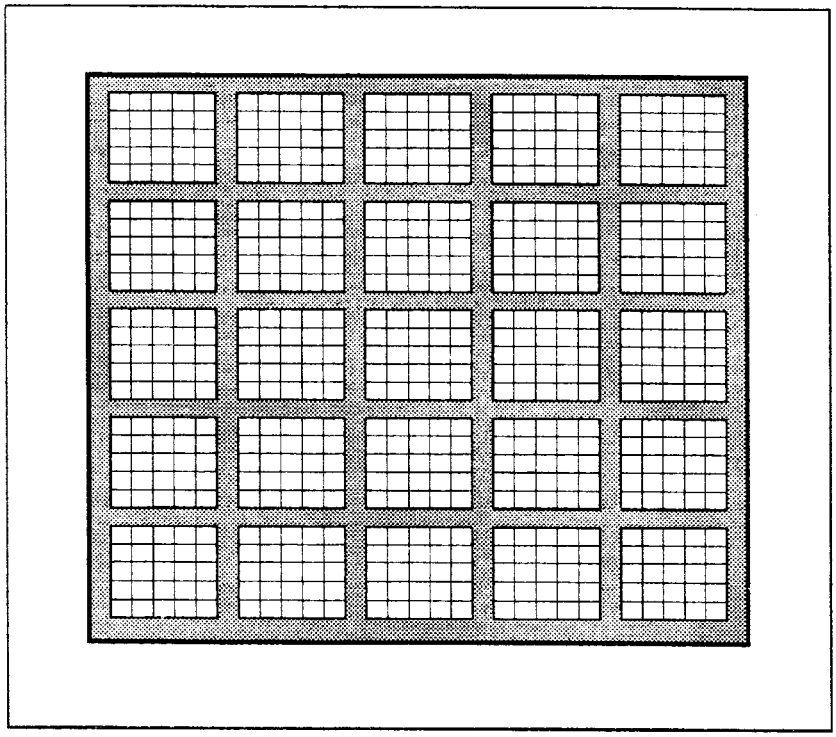
FIG. 4 is a schematic illustration of the game board or array on a computer monitor.

To form the playing board or array, the tiles are arrayed in a 5×5 pattern (a "5×5:5×5" array), as illustrated in FIG. 1. For ease of visual interpretation, the tiles should be separated by approximately the width of a cell, as shown in FIG. 1. The separation distance should be within 0.3 to 3.0 times the width of a cell, more preferably between 0.7 and 2.0 times the width of a cell, still more preferably between 0.9 and 1.2 time the width of a cell, and most preferably between 0.95 and 1.05 the width of a cell.

The board may be implemented physically or electronically, as described further herein.

In another aspect, the invention consists of rules for playing 4D TTT. The play is a particular extension of that of ordinary TTT in 2D. Within one tile, a player can win by occupation of all 5 cells in any row within the tile. In a 5×5 tile, there are five horizontal, five vertical and two diagonal rows in which a player can win.

Figure 2:
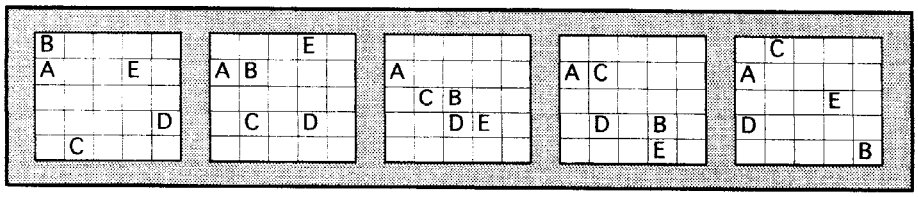
FIG. 2 shows some winning moves, illustrated for simplicity on one of the 12 super-rows (rows, columns or diagonals, as noted above). Each of the four sets A, B, C, and D is a way of winning.

As in 3-D TTT, players can also win by playing in appropriate squares in a row of tiles, where the occupied squares have a systematic relationship. However, because of the added complexity provided by the 4-D space, the rules may provide for either a "regular" row or for a "projective" row for winning. In the regular variant, which is preferred, it is required that the pieces form a "regular" row, as in 3-D TTT. In a 5×5:5×5 array, where each of the tiles and the arrays are numbered as in a spreadsheet, a regular row would consist, for example, of the five positions 1,1:1,1, 2,2:2,2; 3,3:3,3; 4,4:4,4; and 5,5:5,5. (In this notation, used here for convenience, the expression "2,2:2,2" means "the cell that is in the second column down and the second row across of a tile which is in the second row down and the second column across of the array of tiles".) This is the pattern of "B"s in FIG. 2. Another example of a winning regular row would be 1,5:1,1; 1,4:2,1; 1,3:3,1; 1,2:4,1; 1,1:5:1. (This would be the "diagonal" at right angles to pattern "B".) A third example is the row shown as "A" in FIG. 2. "C" and "D" in FIG. 2 illustrate other winning patterns, which may be implemented on any of the 12 super-rows of the array. The "regular" rule set is the most direct and intuitive of the possible rules: a winning row marches in a regular fashion either on a single tile, or through a super-row of the array. This type of rule is practiced in conventional 3D TTT.

The second variant in rules is more difficult to visualize, because it allows for "irregular" rows—it is purely projective. Analogously to the previous example, a winning combination ("projective row") could be 2,2:1,1; 5,5:2,2; 4,4:3,3; 1,1:4,4; 3,3:5,5. If "projected" along the super-row (in this case, a diagonal super-row), the projected positions form a row in the projection plane. Another "projective" win is marked by "E" in FIG. 2; this would not be a winning combination in the "regular" rule set. One way to visualize a winning projective combination is to think of the five tiles of the super-row as being stacked up vertically, and look straight down at the stack. (This could readily be implemented as an option in an electronic version of the game.) If a line of five pieces of the same color is seen, then that player is the winner. This set of rules is less preferred for a two-player game, because it is more likely to give a win to the player who starts first. However, it may be useful in a multiplayer game (i.e., 3 or more players, each with a different type or color of piece), where forming a winning combination can be much more difficult.

Embodiments of the Playing Board

The novel 5×5:5×5 array, (the "array"), preferably including inter-tile spacing as described, can be implemented in any convenient medium. The classical printed folding game board is a possible embodiment. It would be useful to provide at least 100 pieces of each color or type, preferably at least 150, and, if there are only two colors, more preferably at least 200 pieces, since there are 625 cells in the entire array. There is no practical bar to having more than two players in such a game, for example three or four. It is not clear what the preferred strategy might be in a multiplayer game, but that may be a positive attribute for many potential players.

The array can also be printed on disposable media, such as a pad of paper, where the sheet used can be discarded at the end of the game. In addition, the array can be printed in non-erasable form on an erasable substrate, such as a classical blackboard or a "whiteboard", in which case the players can erase their marks at the end of a game. An "Etch-a-Sketch"™ type of device, with an array printed on the unchangeable front surface, would also be suitable.

The array, and in advanced form also the rules, can also be implemented electronically. The simplest form is within the reach of most computer owners with a 12 inch or larger monitor and a spreadsheet or a drawing program. The program could also be implemented on a smaller monitor, or preferably on a larger one; and the directing program may be written in any computer-intelligible language, or for efficiency in lower level codes including without limitation "machine language" and "kernels".

To create a "computer" game board, a 5×5:5×5 array, preferably with inter-tile separation as described, is created electronically, and each player in turn enters his/her mark manually with a mouse or other entry device. The type of entry device is not limited, and may include a keyboard, a trackball, a joystick, a tracking pad, a "touch" -sensitive screen, a light pen, and the like. Entry of a mark may also be made by entering a set of coordinates on the keyboard. Any coordinate system may be used, including the "n, n:n, n" format described above. Mark entry could also be accomplished verbally when the computing device recognizes speech. The makes may be any characteristic which can distinguish that a piece belonging to a particular player has been played at that location. This include changing the color or shading of a cell; placing a character in a cell, such as an "X" or an "O"; and placing an image of a playing piece in a cell.

In this mode, the electronic game is functionally identical to the printed version. The players can experiment with the various rule sets, because all scoring is manual. This format is also implementable on handheld games, palmtop computers and the like, wherever the visual resolution is sufficient. Such devices may have, or may soon have, visual resolution sufficient for displaying the 625 cells of the array. The array may include any number of pixels, provided that the displayed array allows the game to be played. The minimum array, displayed electronically, requires at least 25×25 pixels (which allows no space between tiles). More preferably, the array has at least 29×29 pixels, allowing a blank pixel between each tile. Such an array would be played by marking a point in each cell in a "neutral" color, for example black. Then each player would mark cells by changing their color to his/her particular color; for example, one player could have red pixels and the other blue. In a monochrome system, the array should be at least 57×57 pixels, with one pixel between tiles, and the first player would have (for example) the left-descending pixel pair (1,1:2,2, within the 2×2 pattern of the pixels in the cell) while the other would have the 1,2:2,1) pair. More generous arrays, with more pixels per cell, are clearly preferable. The array illustrated in the Figures was constructed in an Excel® 5.1 spreadsheet, by graying the first and every subsequent sixth row and column. It was easily playable on a 14-inch monitor. Other patterns of darkness and color are within the scope of the invention, as are gradient fills of color, pattern, hue or grayness (of cells in the patttern, or of marks in the cells), or distinctive marking of particular cells or sets of cells, to aid orientation within a super-row. For example, a dot on the center cell of each tile, and small dots at each corner, can be helpful in maintaining orientation when envisaging the more visually complicated rows, such as the "D" pattern of FIG. 2.

The game can also be implemented in game-playing systems which use a television set as output device. In addition, a custom electronic game board could be a liquid crystal array with appropriate programming. A custom program could provide the game on a computer, optionally with the addition of the optional features described below.

Certain optional features can enhance the easy of play, especially for novices. First, a "check alert" function can be valuable. It can be hard, especially for novice players, to notice that the opponent has created a row which will win on the next move unless blocked. An optional addition to the rules, particularly for a non-electronic version, would require a player forming such a combination to notify the other player(s) of the danger. Because the situation is analogous, the adoption of the chess usage of "check" for such a situation would be appropriate, or some other word could be used if agreed on. (A similar notification is used in "Go".) However, because of the game's complexity, it is possible for a player to form such a combination and not notice it at the time! In "manual" mode, one can require a player to notify the other(s) of each "check" situation before it may be completed. This has complexities and potential problems. A better solution is to implement the "check" notification function electronically.

Figure 3:
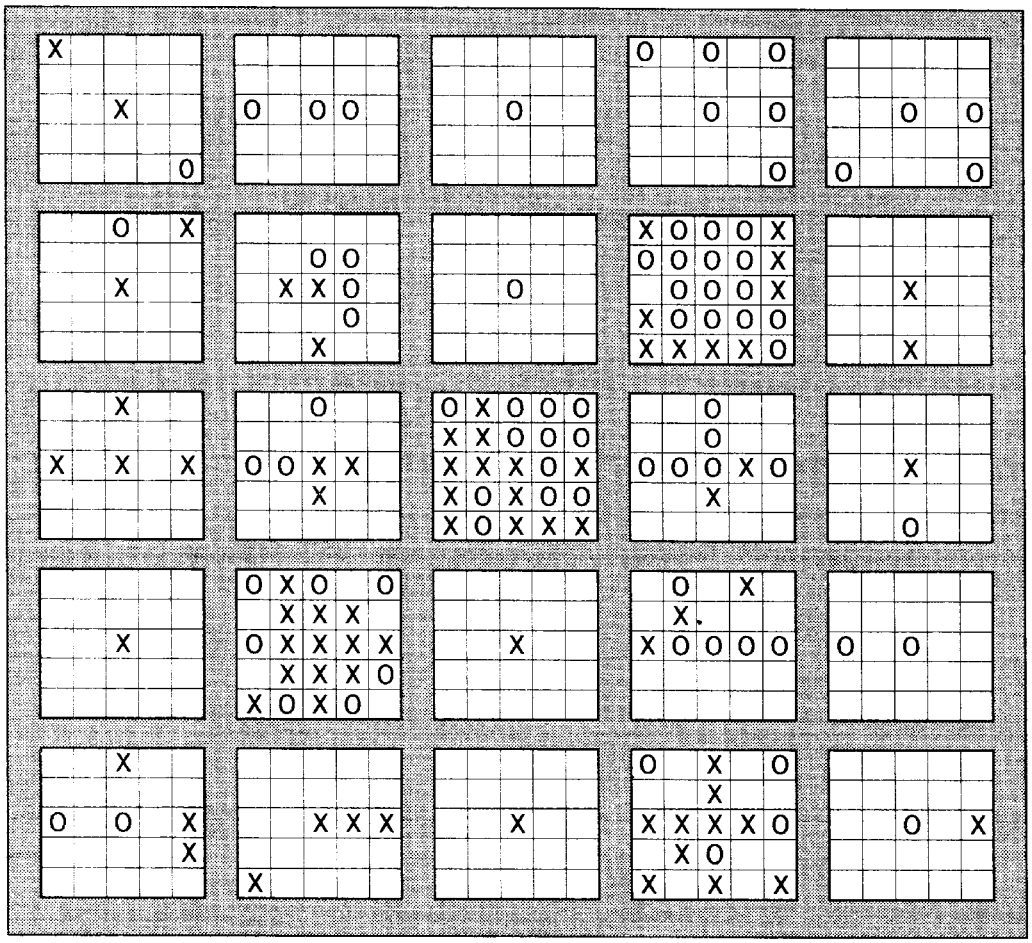
FIG. 3 is an illustration of the game after being played for a number of turns.

Electronic "Check" checking functions may be implemented in a spreadsheet, although speed would be better in a dedicated program. Suppose the players are using "X" and "O" as markers in a "regular" game, as illustrated in FIGS. 2 or 3. (As noted, the cells are cells of an Excel 5.1 spreadsheet, with the tiles separated by grayed rows and columns.) To implement the Check function, the approximately 888 different winning rows are implemented as a look-up table. The set (C2+C8+C14+C20+C26), in spreadsheet style notation, would be one such combination; this corresponds to the A's in FIG. 2, if the super-row is the top horizontal super-row and each represented row is lettered or numbered, including "greyed" rows separating tiles.

After the completion of each move, the computer looks at each potentially winning row and assigns the value of, for example, +1 for each×and −1 for each O, and then sums the cells of the row. Any row that has an absolute value of 4 (i.e., +4 or −4) will win on the next move unless blocked. (Note that a row with 4 Xs and 1 O, or conversely, will have an absolute value of 3). The program then causes the computer to signal the presence of such a combination by any convenient means—for example, coloring the cells of such a row a particular color, or inverting the color scheme, or flashing the cells of the potentially winning row. The program should preferably search all of the potentially winning combinations and indicate each one with the critical value, because the winning "honest" strategy, which assumes that each player can accurately read potentially winning super-rows, is to create two rows or super-rows of absolute value 4 in a single placement. The program could also look for values of ±5, which would indicate a win, and mark the squares involved in a particular manner.

The utility of such a Check function is readily seen by considering FIG. 3, and asking the questions, "Has either player won?", and, "If not, is either player threatening to win on the next move?", and, "If so, where?"

Another function which can be automated is the determination of which side is to move next. The simplest method is to have the program remember who moved last. This could be implemented with an indicator away from the array, or by highlighting the last move. Another way of implementing this function is to assign each "X" a value of 1 and each "O" a value of minus 1 (−1), as before, and then to sum the value of the 625 cells of the array. If the result is 1, then "O" moves next; if −1, then "X" moves next; and if 0, then the player who moved first is next to move. This is a very useful function if the players take a break! Again, consider FIG. 3—whose turn is it? The result of the determination could be displayed in a text overlay, prompted by a command.

A third desirable electronic function, for a sufficiently capable machine, would be to supply the option to graphically overlay the five cells of each super-row so that one could look for two-dimensional patterns in the stack. The five tiles of the super-row would be translucent, so that all of the pieces in the super-row could be seen simultaneously. This can be done with a look-up table showing the 888 winning rows. Selection could be done, as one method, by selecting a row and clicking a box or entering a key combination, resulting in display of the stacked tiles at a location on the screen. The twelve super-row stacks could also be continuously displayed at one end of each super-row. This feature is especially desirable for beginners. It is preferable that this feature can be turned off for advanced play.

What is claimed is:

1. A layout for a game of tic-tac-toe, which is useful for playing tic-tac-toe in four dimensions, consisting of a set of markings on a plane, presented in any suitable medium, wherein the markings designate a square array of 25 tiles, arranged in a 5×5 pattern, and wherein each tile comprises 25 cells, arranged in a 5×5 pattern, and wherein the layout is free of indicate designating particular tiles or cells.

2. The layout of claim 1, wherein each cell is substantially square.

3. The layout of claim 2, wherein each cell is within 25% of being square, as measured by comparing the horizontal extent of a cell with the vertical extent of a cell.

4. The layout of claim 1, wherein the distance between tiles is substantially equal to the width of a cell.

5. The layout of claim 4, wherein said distance between tiles is between 0.7 and 2.0 times the width of a cell.

6. The layout of claim 4, wherein said distance between tiles is between 0.9 and 1.2 times the width of a cell.

7. The layout of claim 1, wherein the layout is presented in tangible form.

8. The layout of claim 1, wherein the layout is presented as the output of an electronic device.

9. The layout of claim 8, wherein each tile is separated from each other tile by at least one pixel.

10. The layout of claim 1, wherein each cell comprises more than one pixel when presented electronically.

11. A method of playing tic-tac-toe in four dimensions, the method comprising:

i) providing a substantially square array of 25 tiles, arranged in a 5×5 pattern; wherein each tile comprises 25 cells, arranged in a 5×5 pattern;

ii) having each player in turn place a marker in one cell of the array;

iii) awarding the win to the first player to make a row of five cells in a row, wherein the row is either a horizontal, vertical or diagonal row within one tile, or the row is regularly arrayed or projectively arrayed in a row within a super-row of the array, wherein a super-row is a set of tiles forming a horizontal, vertical, or diagonal row in the array of tiles;

iv) and further characterized in that no indicate are required on any of said cells and tiles in order for the game to be played.

12. The method of claim 11, wherein said array is presented electronically, by the action of a program on an electronic device having a display.

13. The method of claim 12, wherein each tile of said array is separated from each other tile by at least one pixel.

14. The method of claim 12, wherein each tile of said array is separated from each other tile by two or more pixels.

15. The method of claim 12, wherein each tile of said array is separated from each other tile by at least about 50% of the number of pixels in any dimension of a cell.

16. The method of claim 12, further comprising electronic or other automatic means for implementing a "Check" function as defined herein, for determining when a player is about to complete a winning row.

17. The method of claim 16, further comprising means for signaling when a player is about to complete a winning row.

18. The method of claim 12, further comprising electronic or other automatic means for determining which player is to play next.

19. The method of claim 18, further comprising means for signaling which player is to play next.

20. The method of claim 12, wherein the tiles of a super-row are projected to allow ready visualization of patterns within the super-row.

21. A method of playing tic-tac-toe in four dimensions, the method comprising:

i) providing a substantially square array of 25 tiles, arranged in a 5×5 pattern; wherein each tile comprises 25 cells, arranged in a 5×5 pattern;

ii) having each player in turn place a marker in one cell of the array;

iii) awarding the win to the first player to make a row of five cells in a row, wherein the row is either within one tile, or the row is regularly arrayed or projectively arrayed in a row within a super-row of said array, wherein a super-row is a set of tiles forming a horizontal, vertical, or diagonal row in the array of tiles; and iv) wherein no indicate on the cells or tiles are required in order to play the game; and v) the rules are further characterized in having no provision for removal of pieces once played on the board.

* * * * *